US005192257A

United States Patent [19]

Panasewicz

[11] Patent Number: 5,192,257

[45] Date of Patent: Mar. 9, 1993

[54] EXERCISE APPARATUS

[75] Inventor: John E. Panasewicz, Boulder, Colo.

[73] Assignee: Fittraxx, Inc., Boulder, Colo.

[21] Appl. No.: 875,074

[22] Filed: Apr. 28, 1992

Related U.S. Application Data

[63] Continuation of Ser. No. 728,188, Jul. 10, 1991, abandoned.

[51] Int. Cl.[5] ..... A63B 23/00

[52] U.S. Cl. ..... 482/70; 482/134

[58] Field of Search ..... 482/52, 5, 8, 54, 70, 482/2, 63, 64, 71, 125, 110

[56] References Cited

U.S. PATENT DOCUMENTS

| | | |
|---|---|---|
| 219,139 | 2/1879 | Blend . |
| 219,437 | 9/1879 | Bennett . |
| 1,016,729 | 2/1912 | Barrett . |
| 2,646,282 | 7/1953 | Ringman . |
| 2,969,060 | 1/1961 | Swanda et al. . |
| 3,213,852 | 10/1965 | Zent . |
| 3,363,335 | 1/1968 | Burhns et al. . |
| 3,582,069 | 6/1971 | Flick et al. . |
| 3,940,128 | 2/1976 | Ragone . |
| 3,941,377 | 3/1976 | Lie . |
| 4,023,795 | 5/1977 | Pauls . |
| 4,402,506 | 9/1983 | Jones . |
| 4,434,981 | 3/1984 | Norton . |
| 4,512,571 | 4/1985 | Hermelin . |
| 4,529,194 | 7/1985 | Haaheim . |
| 4,618,139 | 10/1986 | Haaheim . |
| 4,632,385 | 12/1986 | Geraci . |
| 4,659,077 | 4/1987 | Stropkay . |
| 4,679,786 | 7/1987 | Rodgers . |
| 4,709,918 | 12/1987 | Grinblat . |
| 4,714,244 | 12/1987 | Kolomayets et al. . |
| 4,743,015 | 5/1988 | Marshall . |
| 4,798,379 | 1/1989 | Jenkins . |
| 4,842,265 | 6/1989 | Kirk . |
| 4,867,443 | 9/1989 | Jensen . |
| 4,900,013 | 2/1990 | Rodgers, Jr. . |
| 4,979,731 | 12/1990 | Hermelin . |

FOREIGN PATENT DOCUMENTS

| | | |
|---|---|---|
| 490720 | 2/1953 | Canada . |
| 2411365 | 9/1975 | Fed. Rep. of Germany . |
| 2631897 | 1/1978 | Fed. Rep. of Germany . |
| 560622 | 7/1980 | U.S.S.R. . |
| 1049071 | 9/1982 | U.S.S.R. . |
| 1251935 | 3/1985 | U.S.S.R. . |
| 331825 | 7/1930 | United Kingdom . |

*Primary Examiner*—Richard J. Apley
*Assistant Examiner*—Jerome Donnelly
*Attorney, Agent, or Firm*—Gary M. Polumbus

[57] ABSTRACT

An exercise device for simulating cross-country skiing includes a plurality of longitudinally extending channel members mounted on cross frame members so as to define elongated slots in which trolleys for foot supporting members and hand engaging members can reciprocate. A control system interconnecting the foot supporting members and hand engaging members includes a main drive pulley interconnecting the foot supporting members for coordinated reciprocal movement and a secondary belt interconnecting the foot supporting members and hand engaging members so that each hand engaging member will reciprocate in an opposite direction to its associated foot supporting member and at a speed of twice that of the foot supporting member. A resistance structure is provided for resisting movement of the trolleys to provide a selected level of exercise.

12 Claims, 4 Drawing Sheets

EXERCISE APPARATUS

CROSS REFERENCE TO RELATED APPLICATION

This is a continuation of my co-pending application Ser. No. 07/728,188 filed Jul. 10, 1991, abandoned.

BACKGROUND OF THE INVENTION

1. Field of the Invention

The present invention relates generally to exercise apparatus and more particularly to an exercise apparatus that is adapted to simulate cross-country skiing.

2. Description of the Prior Art

While many types of devices and apparatus have been developed and used through the years for assisting an individual in obtaining desired exercise and particularly cardiovascular exercise, it has only been in recent years that the importance of such exercise has been fully appreciated. As a result, numerous types of equipment have been developed to exercise various parts of the body. In some cases, the equipment is designed to develop muscular strength, but in other types of equipment, the goal is directed more to cardiovascular benefits, and such exercise equipment is commonly referred to as aerobic exercise equipment.

Most exercise specialists acknowledge that cross-country skiing is one of the best forms of aerobic exercise in that both the arms and the legs are utilized, thereby more quickly obtaining an elevated heart rate while obtaining and maintaining good muscle tone throughout the body. For this reason, many types of equipment have been developed in an attempt to simulate cross-country skiing so that cross-country skiing movements can be performed in an indoor environment.

There have been numerous cross-country ski simulating devices developed for indoor use such as, for example, those illustrated in U.S. Pat. No. 4,659,077 to Stropkay and U.S. Pat. No. 4,434,981 to Norton. The devices disclosed in these two patents include a pair of foot support platforms adapted to guide the feet in a linear reciprocatory manner while independent hand manipulated means are provided for simulating movement of ski poles. In each device, however, there is no operative connection between the foot and hand movements, and for that reason, the devices have proven difficult to use. Due to the difficulty of coordinating the hand and foot movements, individuals will spend hours, and sometimes days, trying to learn how to use such an apparatus, and in many cases where the apparatus is located in a public exercise facility, the embarrassment will prevent an individual from continuing to use the apparatus.

To avoid the shortcomings of the apparatus disclosed in the Stropkay and Norton patents, cross-country ski exercise devices have been developed wherein the movements of the feet and arms are coordinated by mechanical linkage so that as one foot moves rearwardly the associated hand moves forwardly. In fact, in some of these devices, foot supporting platforms themselves are mechanically linked so that as one foot moves rearwardly the other foot moves forwardly. Examples of such devices are shown in U.S. Pat. No. 4,679,786 issued to Rogers and Canadian Patent No. 490,720 issued to Denison. While the devices disclosed in these patents overcome the coordination problems inherent in the patents to Stropkay and Norton, it will be appreciated that the exercise motion provided by a device wherein the arms and legs are operatively interconnected for simultaneous movement at equivalent speeds, which is biochemically incorrect and awkward, will create a very jerky motion which is not necessarily enjoyable and is difficult to maintain over a long period of time. Further, the jerking movement might cause physiological damage which is not caused by the smooth fluid motion obtained in natural cross-country skiing.

It was to overcome some of the shortcomings in the aforenoted prior art that the apparatus disclosed in U.S. Pat. No. 4,960,276 issued to Feuer et al. was developed. The Feuer patent is of common ownership with the present application. The Feuer apparatus includes means for allowing hand engaging members to move twice as fast a foot engaging supports so that relative movement between the hand engaging members and the foot engaging supports more closely resembles actual cross-country skiing.

As will be appreciated from a review of the prior art, it can be seen that, in order to desirably simulate cross-country skiing, a fairly complex system needs to be employed which can include numerous gears, cables, fly wheels and the like. Some systems are so complex they are readily amenable to breakage or malfunction. Further, some systems have so many interconnected gears or the like that the internal resistance to operation renders them difficult to operate in a manner that provides merely light exercise.

It is to overcome the shortcomings in the prior art devices and to produce a device that closely resembles cross-country skiing that the present invention has been developed.

SUMMARY OF THE INVENTION

The exercise apparatus of the present invention has been designed with simplicity in mind while providing an apparatus that closely resembles cross-country skiing, can be operated continuously over long periods of time and allows for variable resistance to permit very light to very heavy workouts.

The basic framework for the apparatus consists of a plurality of longitudinally extending channel members that are interconnected by cross beams so as to define a horizontal platform on which an individual obtains the desired exercise. A pair of foot supporting members and a pair of hand engaging members are mounted for linear reciprocating movement within the channels defined by the frame members, and a control system interconnects the foot supporting members and hand engaging members to coordinate relative movement. In this manner, associated hands and feet can move in opposite directions with the hands moving at approximately twice the speed of the feet so as to accurately simulate cross-country skiing.

The control system includes a main drive belt interconnecting the foot supporting members through a main drive pulley so that the foot supporting members move in opposite directions. A secondary belt or cable of fixed length is anchored at both ends to the frame and extends around a plurality of idler pulleys while being fixed to the hand engaging members and operably connected to the foot supporting members via an idler pulley. The secondary belt thereby allows the hand engaging members to move reciprocally at twice the speed of the foot supporting members as desired.

The main drive pulley is operatively associated with a mechanical rectifier so as to transmit the reciprocal pivotal movement of the main drive pulley to unidirectional rotation of an output shaft of the rectifier. The output shaft is in turn connected via belt and pulley systems to a conventional flywheel and to a resistance system for variably and selectively restricting the pivotal movement of the main drive pulley. Restriction of the main drive pulley consequently restricts movement of the foot supporting members and hand engaging members which are operatively connected thereto. An electronic sensor is also utilized in conjunction with the resistance pulley to measure the rotational speed of the pulley thereby giving the user of the apparatus an indication of his hypothetical speed relative to the ground.

The flywheel establishes an inertial system so that the apparatus does not place sudden stresses on the user's body. The resistance system permits the apparatus to simulate cross-country skiing from its lightest form of exercise, i.e. traversing a level terrain, to a more difficult exercise, i.e. movement up a hill.

Other aspects, features and details of the present invention can be more completely understood by reference to the following detailed description of a preferred embodiment, taken in conjunction with the drawings and from the appended claims.

DESCRIPTION OF THE PREFERRED EMBODIMENT

Figure 1:
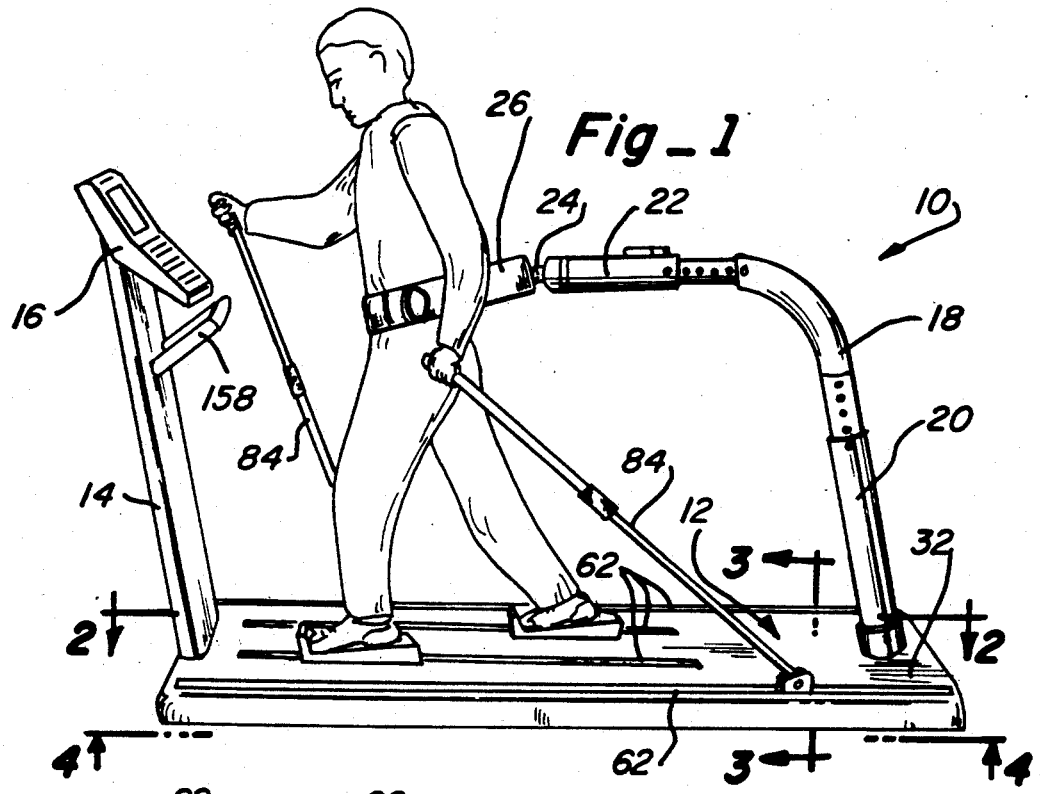
FIG. 1 is an isometric view of the exercise apparatus of the present invention while being used by an individual.
Figure 2:
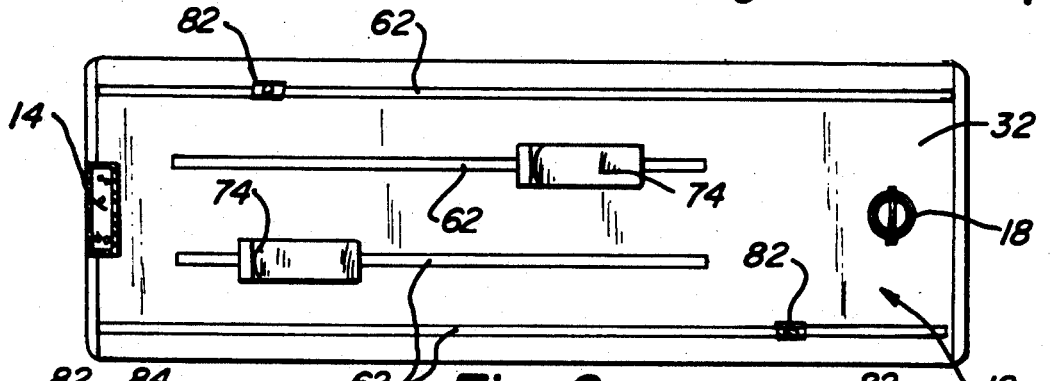
FIG. 2 is a horizontal section taken along line 2—2 of FIG. 1.

The exercise apparatus 10 of the present invention is seen in FIG. 1 to include a base platform 12, an upright standard 14 at the forward end of the platform upon which an electronic control and display device 16 is positioned and an adjustable upright restraining system 18 at the rear end of the platform. The electronic control and display device 16 includes conventional state-of-the-art electronics for controlling the level of exercise desired from the apparatus and for displaying hypothetical ground speeds of operation of the apparatus as well as estimations of hypothetical distance covered and other such information.

The upright restraining system 18 at the rear end of the platform has a substantially vertical segment 20 which is adjustable in length in a conventional manner and a horizontal segment 22 which is also adjustable in length. The terminal end of the horizontal segment 22 carries a vertically pivotal joint 24 to which a belt 26 is operatively connected with the belt being adapted to extend around the waist of a user of the apparatus. The vertical and horizontal adjustments are provided to accommodate various sized individuals so that when using the apparatus an individual is restrained and will not move forwardly in the apparatus.

With reference to FIGS. 3, 4, 6, 7 and 8, the base platform 12 can be seen to include a framework of longitudinally extending channel extrusions 28 and cross-frame members 30*a*, 30*b*, 30*c*, 30*d*, 30*e* and 30*f* interconnecting the extrusions in a desired spaced relationship. A cover sheet 32, FIG. 1, overlies the framework to enclose most of the working components of the apparatus.

Figure 3:
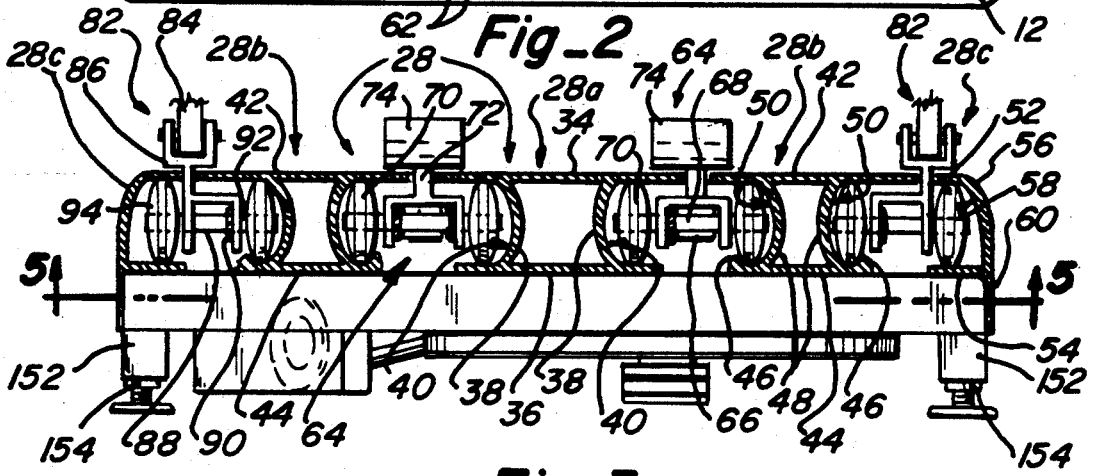
FIG. 3 is an enlarged vertical section taken along line 3—3 of FIG. 1.

As probably best illustrated in FIG. 3, there are five longitudinally extending channel extrusion members 28 of three different cross-sectional configurations identified by reference numerals 28*a*, 28*b* and 28*c*. A central extrusion 28*a* has an upper plate 34 and a lower plate 36 which are interconnected by arcuate outwardly concave webs 38 which define outwardly opening channels 40 for a purpose to be described in more detail later. A pair of intermediate extrusions 28*b* are positioned adjacent to and in parallel relationship with the central extrusion 28*a*, and they also include an upper plate 42 and a lower plate 44. The lower plate 44 includes raised ribs 46 along its lateral edges for a purpose to be described later. As with the central extrusion, the intermediate extrusions 28*b* have their upper and lower plates interconnected by arcuate outwardly concave webs 48 which define inwardly and outwardly opening channels 50. Outer side extrusions 28*c* are positioned adjacent to the intermediate extrusions 28*b* on the side opposite from the central extrusion 28*a*. The outer side extrusions include an upper plate 52 and a lower plate 54 with an arcuate and inwardly concave side web 56 interconnecting the upper and lower plates. The web 56 in cooperation with the lower plate 54 defines an inwardly opening channel 58. The side web has a vertically extending skirt 60 forming a downward extension from the outermost side edge of the bottom plate.

The cover sheet 32 previously mentioned in connection with the platform 12 overlies the skeletal framework shown in FIG. 3, but has not been illustrated in FIG. 3 for clarity purposes.

Figure 5:
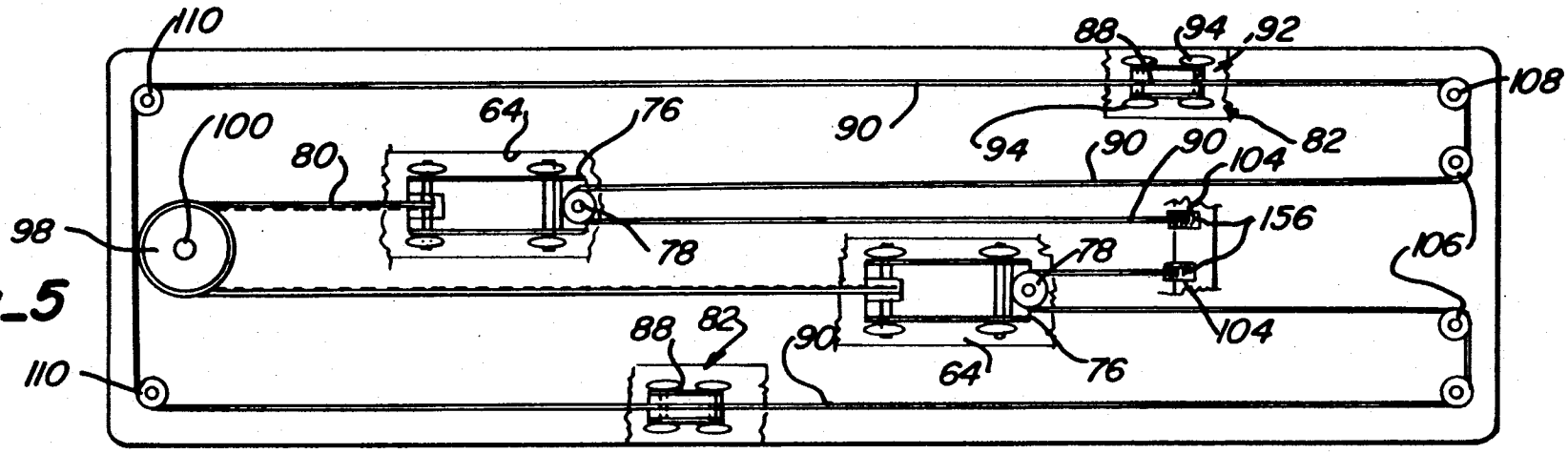
FIG. 5 is schematic section taken along line 5—5 of FIG. 3 with parts removed for clarity.

As best seen in FIGS. 3 and 5, the six longitudinally spaced cross beams 30*a*, 30*b*, 30*c*, 30*d*, 30*e* and 30*f* interconnect the channel extrusions 28 along their bottom plates and in a manner such that the channel extrusions extend longitudinally of the apparatus in slightly spaced relationship to each other so as to define four parallel longitudinally extending slots 62 between adjacent edges of the upper plates.

A pair of foot supporting members 64 which may be referred to as foot trolleys are adapted to roll within the confronting channels defined by the webs of the central and intermediate channel extrusions 28*a* and 28*b*, respectively. Each trolley 64 includes a base frame member 66 in which a pair of parallel laterally extending axles 68 are mounted with each axle having a pair of wheels 70 rotatably disposed on its ends. A neck portion 72 of each base frame member 66 projects upwardly through a slot 62 and is integral with a platform 74 having a forwardly inclined upper surface. The platform 74 defines the support surface upon which an individual's feet are positioned and the forward incline has been found desirable in facilitating use of the apparatus. The base frame member 66 of each foot supporting trolley has a bracket 76 attached to the trailing end thereof which supports a horizontal idler pulley 78 for a purpose to be described in more detail hereinafter. The leading end of the base frame 66 for each foot supporting trolley has means for anchoring a timing belt 80 the purpose for which will become more clear with the description that follows.

A pair of hand engaging members 82 which may be referred to as hand trolleys include simulated ski poles 84 which can be gripped by a user of the device. The poles are pivotally connected through a yoke and pin connector 86 to an integral base frame 88 of an associated trolley. The base frame 88 of the hand trolleys is of inverted U-shaped tubular configuration so that a belt 90 can be extended longitudinally therethrough while being fixedly attached to the trolley. The function of the belt will be described later. Each hand trolley has a pair of parallel transverse axles 92 carrying rotatable wheels 94 on opposite ends thereof with the wheels being adapted to ride within opposing channels of the intermediate extrusions **28*b* and the outer side extrusions 28*c*. The yoke in the yoke and pin connector 86 on each trolley extends upwardly from the base frame through the slot 62 between the intermediate extrusions 28*b* and the outer side extrusions 28*c*. The poles 84** themselves are adjustable in length to accommodate various height individuals.

Figure 4:
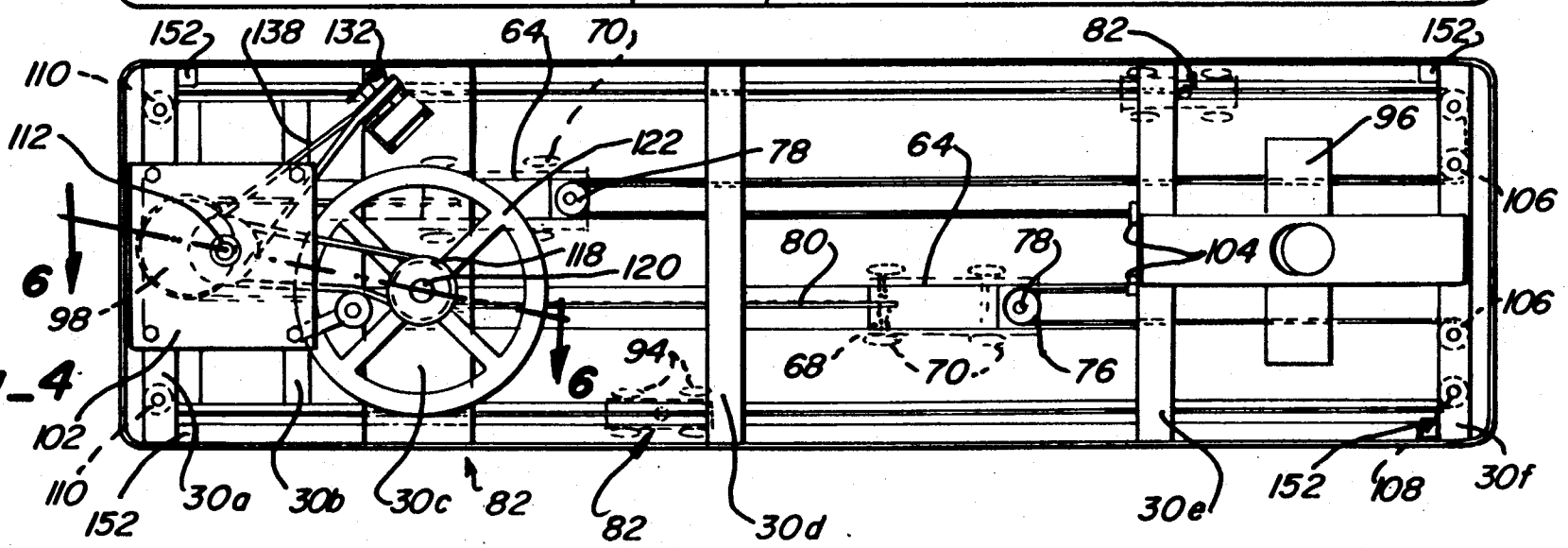
FIG. 4 is an enlarged section taken along line 4—4 of FIG. 1 with parts removed for clarity.

The upright restraining standard 18 is anchored to the base platform 12 by a shortened cross frame member 96 seen in FIG. 4. The shortened cross frame member is attached to the underside of the channel extrusions 28 but rearwardly of the area in which the foot supporting members 64 are reciprocated so that the standard does not interfere with the movement of the trolleys. This can be appreciated by reference to FIG. 1.

A control system for interconnecting and coordinating the movement of the foot supporting members 64 and the hand engaging members 82 is shown best in FIGS. 4 and 5. With particular reference to FIG. 5, the timing belt 80 is seen anchored at opposite ends to the front end of each foot supporting member 64. The timing belt extends around a horizontally disposed main drive pulley 98 at the front end of the apparatus 10 which is mounted for reciprocal pivotal movement on a vertical shaft 100. The shaft 100 is part of a mechanical rectifier 102 to be described later. A secondary belt or cable previously identified with reference 90, which may be a heavy cloth belt or any other substantially non-elastic belt, has opposite ends anchored at 104 in close proximity to each other to cross frame member **30*e* near but not at the rear end of the apparatus. The secondary belt 90 from its anchored locations extends forwardly around the idler pulleys 78 on the trailing ends of the foot supporting members before returning rearwardly to pass around inner idler pulleys 106 at the rear end of the apparatus 10 and subsequently laterally outwardly around second idler pulleys 108 at the rear end of the apparatus. The belt 90 makes right angle turns around the pulleys 108 before extending forwardly for right angle passage around idler pulleys 110 at opposite corners of the front end of the apparatus. Along the belt's extent toward the front idler pulleys 110, the secondary belt is fixed to the hand engaging members 82 so that the members 82 move reciprocally in unison with the belt 90. The idler pulleys at the front and rear end of the apparatus, around which the secondary belt extends, are anchored to associated cross frame members 30*a* and 30*e***, respectively, in suitable bearings, not seen.

It can be seen from the arrangement of the timing belt 80 and the secondary belt 90 that movement of either of the foot supporting members 64 along its associated slot 62 will cause the opposite foot supporting member to move in an opposite direction. Simultaneously, the hand engaging members 82 are caused to move in an opposite direction to its adjacent foot supporting member. It will also be appreciated that the hand engaging members will move at a linear speed of twice that of the foot supporting members.

Figure 6:
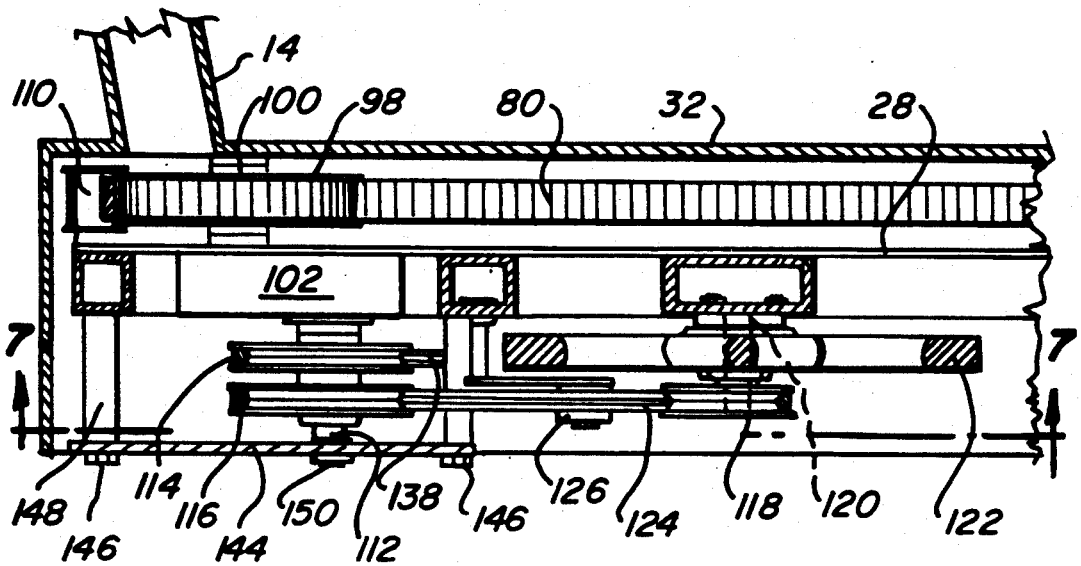
FIG. 6 is a further enlarged section taken along line 6—6 of FIG. 4.
Figure 7:
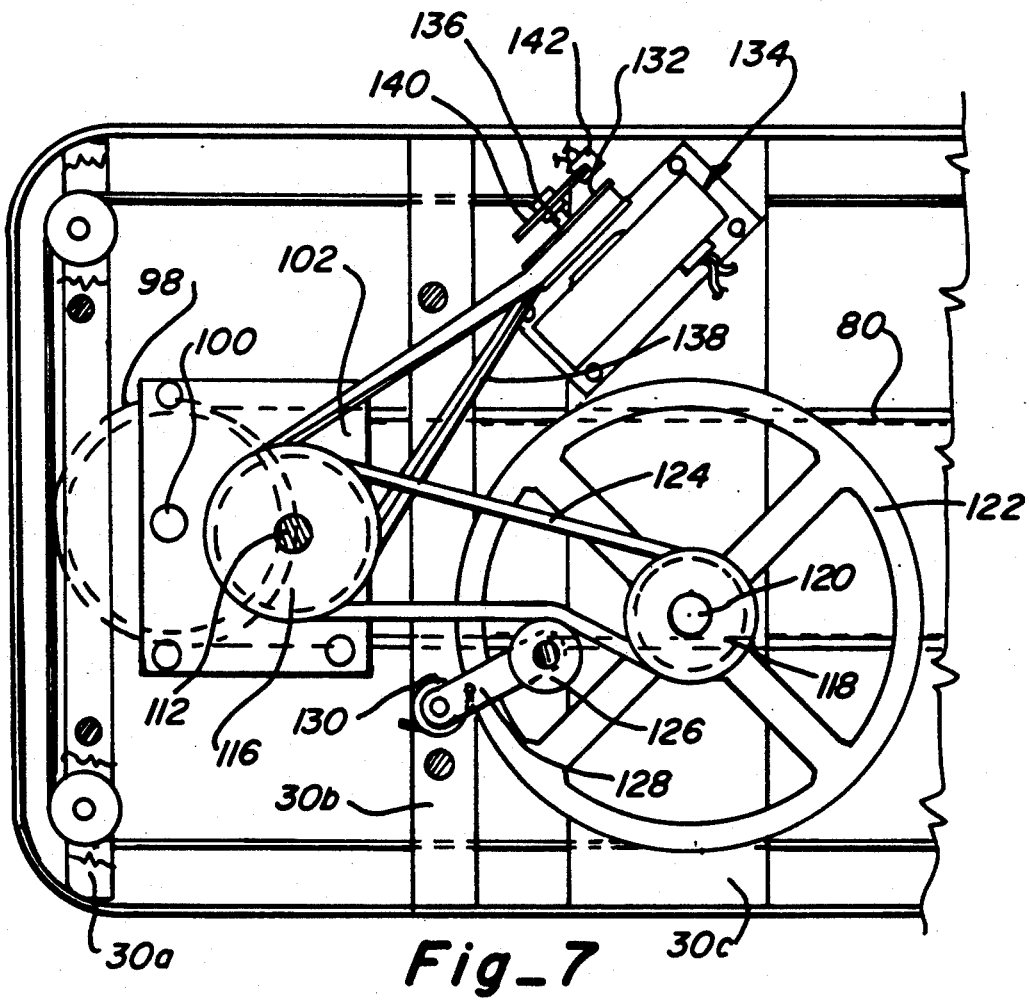
FIG. 7 is a section taken along line 7—7 of FIG. 6.
Figure 8:
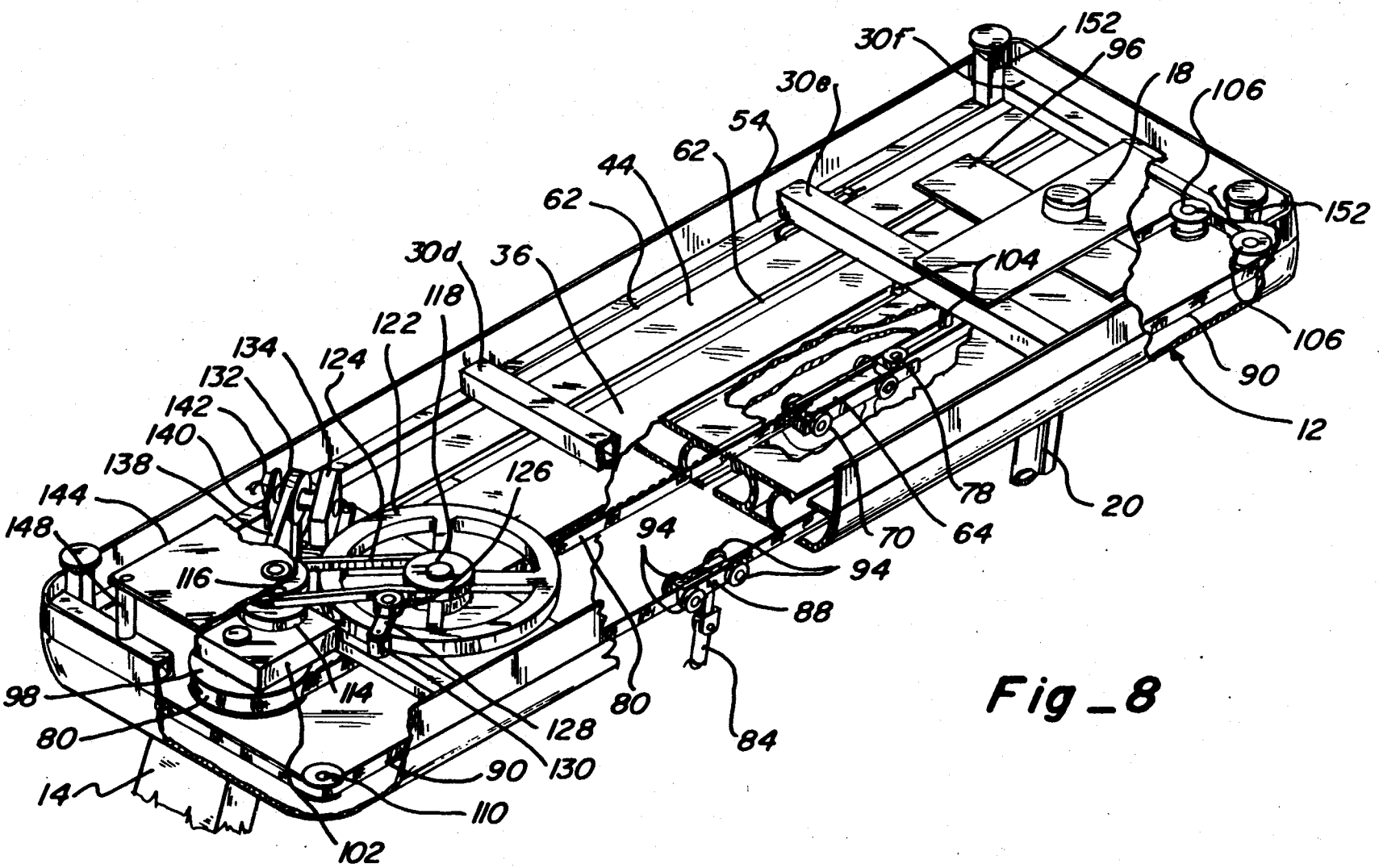
FIG. 8 is an isometric view of the base platform of the apparatus with portions broken away for clarity.

The shaft 100 on which the main drive pulley 98 is mounted forms an input shaft to the mechanical rectifier 102 which is best seen in FIGS. 4 and 6. The output shaft 112 of the rectifier extends downwardly and carries stacked upper and lower pulleys 114 and 116, respectively. According to the inherent function of a mechanical rectifier, pivotal movement of the input shaft 100 on which the main drive pulley 98 is mounted causes a continuous unidirectional movement of the output shaft 112 and consequently each of the pulleys 114 and 116 which are fixedly mounted thereon.

The pulley 116 on the output shaft of the rectifier is in alignment with a flywheel pulley 118 which is disposed rearwardly thereof relative to the length of the apparatus but in the same horizontal plane. The flywheel pulley is mounted on a shaft 120 via a conventional slip clutch (not seen) with the shaft 120 being anchored to and projecting downwardly from cross frame member **30*c*. A conventional flywheel 122 is also connected in a fixed manner to the shaft 120 so as to rotate in unison with the shaft. A flywheel belt 124 extends around pulley 116 and the flywheel pulley and is engaged by a tensioning pulley 126 (FIG. 7) which is mounted on a swivel arm 128 that is spring biased by a torsion spring 130 into engagement with the belt 124** to retain a desired tension in the belt.

The upper pulley 114 on the output shaft 112 of the rectifier 102 is in horizontal alignment with a vertically disposed resistance pulley 132 forming a part of a resistance system which includes a conventional infinitely variable electronic brake or adjustment component 134 for selectively and variably restricting the rotational movement of the resistance pulley 132. The resistance pulley is keyed to an output shaft 136 of the electronic brake component 134, and a resistance pulley belt 138 interconnects the resistance pulley 132 with the upper pulley 114 on the output shaft of the rectifier so that resistance to rotative movement of the resistance pulley by the electronic brake component can be transmitted to the output shaft of the rectifier 102 and consequently to the input shaft 100 of the rectifier on which the main drive pulley 98 is mounted. In this manner, the resistance to movement of the foot supporting members 64 and the hand engaging members 82 can be regulated by the electronic brake component which in turn can be controlled in a conventional manner from the electronic control and display device 16 described previously.

Also mounted on the output shaft 136 of the electronic brake component 134 is a coded disc 140 which cooperates with a sensor 142 that detects rotative movement of the disc 140 and in combination with the electronic control and display device 16 converts that movement into information indicative of the speed of rotation of the disc. This information is conventionally converted to a digitized readout of a relative linear speed indicative of the hypothetical speed of movement which a user of the apparatus might have relative to the ground. The electronic brake component 134 and consequently the resistance pulley 132 and speed sensing disc 140 associated therewith are anchored to cross beam **30*c*** near the front of the apparatus.

With reference to FIG. 6, a cover plate 144 is suspended from cross frame members 30*a* and 30*b* at the front of the apparatus through bolts 146 and spacers 148 (FIG. 6) so as to cover some of the working components of the apparatus. The cover plate also has a bearing 150 mounted therein to receive the lower end of the output shaft 112 of the rectifier. One of the bolts connecting the cover plate to the cross frame members also serves as a pivotal shaft for the swivel arm 128 carrying the tensioning pulley 126 and the associated torsion spring 130.

In order to support the framework for the apparatus at a desired height, square tubular members 152 are welded to cross frame members 30*a* and 30*f* at the front and rear of the apparatus, respectively, to conventionally receive adjustable legs 154 as best illustrated in FIGS. 3 and 4.

As is well known in the art, the flywheel 122 establishes inertia for the system which virtually eliminates any jerking motion in use of the apparatus. To assist in this regard, the slip clutch absorbs any sudden torque changes. As mentioned previously, such jerking motion undesirably stresses joints in the body which might cause physiological damage to a user of the apparatus. A further means for preventing damage of this type could be incorporated into the apparatus at the connection 104 of the secondary belt 90 to the framework. At this location, coil springs 156, FIG. 5, could be utilized to attach the end of the belt to the framework which would cushion the movement of the foot supporting members 64 and the hand engaging members 82.

It will be noted from the description of the apparatus that it is relatively simple in construction, not only in the basic framework of the apparatus wherein the channel members 28 for guiding the trolleys also form structural components, but also in the control system. The simplicity of the control system enables a user of the apparatus to operate the apparatus with minimal resistance if desired to achieve a very light exercise. On the other hand, through use of the braking component 134 and the resistance belt 138 and pulley 132, the resistance to movement of the trolleys can give a user an unusually heavy exercise which might simulate uphill skiing. Safeguards to physiological damage have also been incorporated into the system in a simplified manner so that the apparatus is safe to use while providing any desired level of exercise over any desired period of time.

In an alternative mode of operation, the ski poles 84 can be removed from the hand engaging members 82, and a user of the apparatus can merely grip a U-shaped handle 158 secured to the standard 14 at the front of the apparatus immediately beneath the electronic control and display system 16. In this manner, the user would develop exercise of the lower torso but not the upper torso if this were either desired or dictated by an individual's condition.

Although the present invention has been described with a certain degree of particularity, it is understood that the present disclosure has been made by way of example, and changes in detail or structure may be made without departing from the spirit of the invention, as defined in the appended claims.

I claim:

1. An exercise apparatus comprising in combination:

a frame, a pair of foot supporting members, slidably mounted on said frame for linear reciprocating movement, each foot supporting member having a first idler pulley thereon, a pair of hand engaging members slidably mounted on said frame for linear reciprocating movement in parallel relationship with the movement of said foot supporting members, and a control system operably interconnecting said foot supporting members and said hand engaging members, said control system including a drive pulley mounted on said frame for reciprocal pivotal movement and a drive belt extending around said drive pulley, said drive belt having opposite ends fixed to said foot supporting members whereby movement of one foot supporting member in a first direction will cause the other foot supporting member to move simultaneously in a second opposite direction, a secondary belt having opposite ends anchored to said frame, said secondary belt being fixed to said hand engaging members for unitary movement therewith and being operably connected to said foot supporting members by frictionally passing around said first idler pulleys on the foot supporting members, and a group of second idler pulleys mounted on said framework around which said secondary belt extends whereby linear reciprocating movement of said foot supporting members causes said hand engaging members to reciprocate at a linear speed of approximately twice the speed of said foot supporting members.

2. The exercise apparatus of claim 1 further including a flywheel mounted on said frame, a mechanical rectifier mounted on said frame and being operably interconnected with said drive pulley, and a flywheel belt interconnecting said rectifier with the flywheel whereby pivotal reciprocal movement of said drive pulley causes unidirectional rotation of said flywheel.

3. The exercise apparatus of claim 1 further including a resistance pulley rotatably mounted on said frame, adjustment means for selectively and variably restricting the rotation of said resistance pulley, a mechanical rectifier mounted on said frame and being operably interconnected with said drive pulley, and a resistance belt interconnecting said rectifier with the resistance pulley whereby a varied resistance to rotation can be imparted to said drive pulley by selectively varying the adjustment means.

4. The exercise apparatus of claim 2 further including a resistance pulley rotatably mounted on said frame, adjustment means for selectively and variably restricting the rotation of said resistance pulley, a mechanical rectifier mounted on said frame and being operably interconnected with said drive pulley, and a resistance belt interconnecting said rectifier with the resistance pulley whereby a varied resistance to rotation can be imparted to said drive pulley by selectively varying the adjustment means.

5. The exercise apparatus of claim 3 wherein said adjustment means is a variable electronic brake.

6. The exercise apparatus of claim 1 wherein said frame is of generally rectangular configuration defining a first end and a second end, said drive pulley being disposed adjacent to said first end and wherein said group of second idler pulleys includes a pulley on either side of said drive pulley at said first end in alignment with the linear movement of said hand engaging members, a pair of pulleys at said second end in alignment with the linear movement of said hand engaging members and a pair of pulleys at said second end in alignment with said foot supporting members.

7. The exercise apparatus of claim 6 wherein said ends of the secondary belt are anchored to the frame at a location between said second end of the frame and said foot supporting members.

8. The exercise apparatus of claim 7 wherein said frame includes a plurality of longitudinally extending channel members defining slots therebetween and being interconnected by a plurality of cross frame members, said channel members supporting said foot supporting members and hand engaging members.

9. The exercise apparatus of claim 8 wherein said foot supporting members and hand engaging members include wheels adapted to roll in and be guided by said channel members.

10. The exercise apparatus of claim 4 further including rotative movement detecting means associated with said resistance pulley, said detecting means being adapted to sense and display information relative to the speed at which the foot supporting members and hand engaging members are being moved.

11. The exercise apparatus of claim 10 wherein said detecting means is electronic.

12. An exercise apparatus comprising in combination:

a frame, a pair of foot-supporting members slidably mounted on said frame for linear reciprocating movement, a pair of hand-engaging members slidably mounted on said frame for linear reciprocating movement in parallel relationship with the movement of said foot-supporting members, and a control system operably interconnecting said foot supporting members and said hand-engaging members, aid control system including a drive belt having opposite ends fixed to said foot supporting members whereby movement of one foot-supporting member in a first direction will cause the other foot-supporting member in a first direction will cause the other foot-supporting member to move simultaneously in a second opposite direction, and a secondary belt having opposite ends anchored to said frame and being fixed to said hand-engaging members for unitary movement therewith.

* * * * *